US005227845A

United States Patent [19]

Hiranuma et al.

[11] Patent Number: 5,227,845

[45] Date of Patent: Jul. 13, 1993

[54] COPYING APPARATUS

[75] Inventors: Susumu Hiranuma; Koji Fukushima; Yoshihiro Maekawa, all of Japan

[73] Assignee: Fuji Xerox Co., Ltd., Tokyo, Japan

[21] Appl. No.: 773,798

[22] Filed: Oct. 9, 1991

[30] Foreign Application Priority Data

Nov. 13, 1990 [JP] Japan ..... 2-303865

[51] Int. Cl.[5] ..... G03G 15/04

[52] U.S. Cl. ..... 355/228; 354/482; 355/38

[58] Field of Search ..... 355/228, 229, 232, 35, 355/38, 71; 354/430, 482

[56] References Cited

U.S. PATENT DOCUMENTS 4,226,527 10/1980 Lama et al. ..... 355/71
4,774,548 9/1988 Beaulieu et al. ..... 355/35 X
4,905,039 2/1990 Terashita ..... 355/35
5,065,184 11/1991 Iimori et al. ..... 355/208
5,083,154 1/1992 Terashita et al. ..... 355/68
5,084,729 1/1992 Yakubo et al. ..... 355/71 X

*Primary Examiner*—Michael L. Gellner
*Assistant Examiner*—P. J. Stanzione
*Attorney, Agent, or Firm*—Finnegan, Henderson, Farabow, Garrett & Dunner

[57] ABSTRACT

An apparatus for performing a copying operation contains a photosensitive drum, a focusing optical system for directing reflected light from an original image onto the photosensitive drum, a lamp for lighting the original image, a light quantity sensor for detecting the quantity of reflected light from the original image and for controlling the quantity of light of the lamp on the basis of the detected value of the quantity of reflected light, a first filter provided in an optical path of the focusing optical system so as to cut-off light having a wavelength not longer than a predetermined value, and a second filter provided on a light-detection surface of the light quantity sensor. The second filter has a cut-off wavelength point shorter than the first filter.

8 Claims, 4 Drawing Sheets

COPYING APPARATUS

BACKGROUND OF THE INVENTION

1. Field of the Invention

The present invention relates to an apparatus for performing copying by using an improved optical system.

2. Description of the Prior Art

Known is a copying apparatus having a photosensitive drum, a focusing optical system for leading reflected light from an original image onto the photosensitive drum, an original lighting means, a detection means for detecting the quantity of reflected light from the original image, and a control means for controlling the quantity of light from the original lighting means on the basis of the detected quantity of reflected light. In this known copying apparatus, it has been widely performed to insert a yellow filter into the focusing optical system for the purpose of improving the density of blue color reproduction. In this case, however, there has been a problem with color reproducibility of originals of colors other than blue (mainly, originals of a magenta group color). Further, in the case of using a sheet-like transmission-type filter, there has been a problem that resolving power is apt to be lowered by the reduction in optical performance due to curling.

SUMMARY OF THE INVENTION

It is therefore an object of the present invention to solve the foregoing problems in the prior art. It is another object of the present invention to provide a copying apparatus in which it is possible to solve the problem of "defective blue color reproduction (low density)" caused in the case of using a photosensitive body which is low in spectral sensitivity in a red color region (600–700 nm), without changing the color reproducibility of colors other than blue.

In order to attain the above objects, the apparatus for performing a copying operation comprises: a photosensitive drum; a focusing optical system for leading, or directing reflected light from an original image onto the photosensitive drum; an original lighting means for lighting the original; a light quantity sensor for detecting the quantity of reflected light from the original image and for controlling the quantity of light of the original lighting means on the basis of the detected quantity of reflected light; a first filter provided in an optical path of the focusing optical system so as to cut-off light having a wavelength not longer than a predetermined value; and a second filter provided on a light-detection surface of the light quantity sensor and having a cut-off wavelength point shorter than the first filter.

According to the present invention a yellow filter is inserted as a first filter in an optical path to a photosensitive body of a focusing optical system (i.e., in the optical path from an original image, through lenses, to a surface of a photosensitive body) so as to cut-off blue light. Another yellow filter, the cut-off wavelength of which is shifted to a range of wavelength shorter than the first yellow filter, is attached as a second filter on a light quantity sensor. The light quantity sensor detects the quantity of reflected light from an original image surface, and through feedback controls the quantity of light from a lighting lamp.

The operation of the present invention will be described in the case where a photosensitive body that has spectral sensitivity at long wavelengths as shown in FIG. 2 and that is low in sensitivity at the long wavelength side is used as a photosensitive drum, a color pen such as a fiber-tipped or a ballpoint pen, or the like, having a spectral reflection factor as shown in FIG. 3 is used as an original, and a halogen lamp having a spectral characteristic as shown in FIG. 4 is used as a lighting lamp.

The reason why the blue color reproducibility is low in the case of a photosensitive body having spectral sensitivity as shown in FIG. 2 is that the color of an original which is ordinarily called "a blue color" is "a cyan color" in FIG. 3, and the curve of the spectral reflection factor of "cyan" has a shape approximate to that of the spectral sensitivity curve of the photosensitive body. Therefore, the photosensitive body shows a response approximate to a white color or a grey color of low density for a blue original. The density of red color reproducibility, on the contrary, is high for the opposite reason, that is, because the photosensitive body shows a response substantially equivalent to black.

As described above, if it is an object only to improve the blue color (cyan) reproducibility, a yellow filter may be inserted into an optical path to a photosensitive body so as to cut-off blue light (400–500 nm). In this case, however, there occurs a defect in that also the density of fog increases with respect to intermediate color originals (colored paper). As shown in FIG. 3, the density of reproduction becomes high for pink originals, orange originals, or the like, having a relatively high spectral reflection factor even in a blue light region. This defect is important because intermediate color originals are widely used as business vouchers.

According to the present invention, such a defect as described above is eliminated by a combination of the first and the second yellow filters. Next, description will be made as to the reason why this combination is effective in the copying apparatus according to the present invention.

First, the light quantity sensor is provided for the purpose of controlling the quantity of light from the lighting lamp in accordance with the density of an original to thereby adjust the surface potential in the background portion of the photosensitive body to be always at a fixed level so as to suppress generation of fog. Therefore, the distribution of the spectral sensitivity of the light quantity sensor is normally set to be equivalent to that of the spectral sensitivity of the photosensitive body. A silicon photodiode light quantity sensor in which the long wavelength side is cut off, for example, could serve as the light quantity sensor, according to the present invention.

Although it is necessary to cut off the blue light component of the incident light onto the photosensitive body in order to improve the blue color reproducibility, the blue color reproducibility is not improved where a light quantity sensor as described above is used merely in the state where its spectral sensitivity is left equal to that of the photosensitive body. Further, when the first yellow filter, inserted in the optical path to the photosensitive body, is also applied to the light quantity sensor, the improvement of the blue color reproducibility cannot be attained. This is because the output voltage of the light quantity sensor decreases in relation to the amount of the blue light component cut off by the first yellow filter. It is therefore necessary to increase the voltage applied to the lighting lamp in order to compensate for the decrease in the output voltage of the light quantity sensor.

According to the present invention, however, the foregoing problem is solved by providing, in the light quantity sensor side of the optical path, the second yellow filter having a cut-off wavelength point in the shorter wavelength side than the first yellow filter. That is, the cut-off wavelength of the second yellow filter, applied onto the light quantity sensor, is shifted to the shorter wavelength side of the first yellow filter, applied in the photosensitive body side of the optical path. This suppresses the increase of the lighting lamp voltage caused by the cut off of the blue light component, as well as to thereby suppress occurrence of fog in the case of pink-colored or orange-colored original.

FIG. 5 is a diagram for explaining the foregoing state with respect to the system response. In the drawing, A represents the system response of the photosensitive body when the first yellow filter was not provided; B, the system response of the photosensitive body when the first yellow filter was provided; C, the system response of the light quantity sensor when the first yellow filter was provided; and D, the system response of the light quantity sensor when the second yellow filter was provided. As seen from FIG. 5, the system response of the photosensitive body was brought into the state of B by the provision of the first yellow filter, and the system response of the light quantity sensor was brought into the state of D by the provision of the second yellow filter, whereby the foregoing objects were attained.

Here, the term "system response" means an integrated value of the products between the spectral sensitivity of the photosensitive body (or the light quantity sensor), the spectral energy of the lamp, and the spectral transmission factor of the filter for every wavelength component. For example, the system response (SR) of the photosensitive body is represented by the following expression.

$$SR \text{ of the photosensitive body} = -\int E(\lambda)F(\lambda)d\lambda$$

(in the expression, E(λ) represents the lamp spectral energy; F(λ) represents the filter spectral transmission factor; and P(λ) represents the photosensitive body spectral sensitivity).

DETAILED DESCRIPTION OF THE PREFERRED EMBODIMENT

Figure 6:
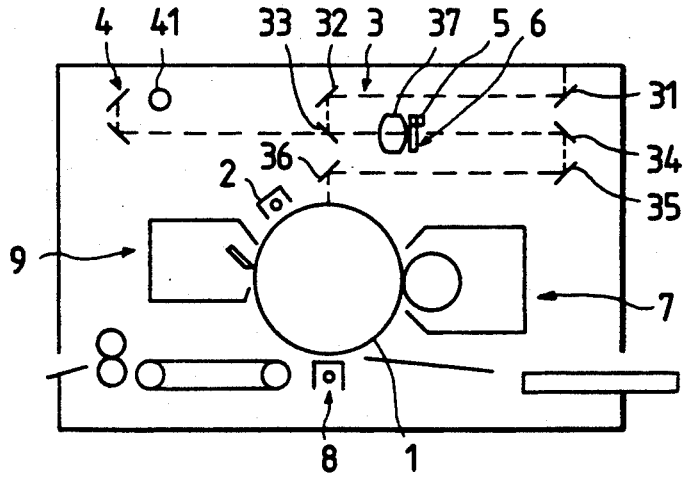
FIG. 6 is a schematic diagram showing a copying apparatus in which the present invention is embodied.

Next, the present invention will be described on the basis of a specific example. The copying operation was performed by using such a copying apparatus as shown in FIG. 6. In the illustrated configuration of the copying apparatus, there are provided: a photosensitive drum 1; a corona charger 2; a focusing optical system 3, constituted by reflection mirrors 31–36 for leading reflected light from an original image to the photosensitive drum 1 and a focusing lens 37; a paper lighting means 4 constituted by a halogen lamp 41; a light quantity sensor 5 for detecting the quantity of reflected light from the original image; a yellow filter device 6; a developing unit 7; a transfer unit 8; and a cleaning unit 9. In the copying apparatus according to the present invention, the yellow filter device 6 is constituted by a first filter for cutting-off light having a wavelength not longer than a predetermined value and a second filter having a cut-off wavelength point in the shorter wavelength side than the first filter. The second filter is attached onto the photo-detective surface of the light quantity sensor 5.

Figure 8:
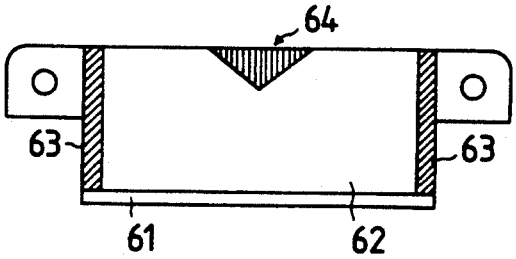
FIG. 8 is a plan showing the state where the filters are stuck in the copying apparatus according to the present invention.

In the foregoing copying apparatus, the first yellow filter, which is the first filter for the photosensitive body, and the second yellow filter, which is the second filter for the light quantity sensor, are attached onto the lighting and focusing optical systems respectively. A double-sided, or both-side adhesive tape is stuck, or in other words attached, on the first and the second filters in the areas other than the optical path, and the first and the second filters are then stuck on an attachment bracket and the front surface of a sensor photodetective window respectively. FIG. 8 shows the state of attachment of the first and the second filters. An attachment bracket 61 is provided on the focusing lens at the photosensitive body side thereof so as to act as a shading correction plate for the lighting and focusing optical systems and to function as a light quantity sensor attachment bracket. A first filter 62 is stuck on the attachment bracket through double-sided adhesion. A second filter 64 is stuck on the photo-detective surface of the light quantity sensor with a double-sided adhesive tape.

The photosensitive drum 1 is uniformly charged by the corona charger 2 through ab ordinary method and then exposed with image carrying light by means of the focusing optical system 3 and the lighting means 4 so that an electrostatic latent image is formed on the photosensitive drum 1. In this case, the quantity of reflected light from the original image is detected by the light quantity sensor 5 and the quantity of light of the halogen lamp 41 constituting the original lighting means is controlled by a control means (not shown). Next, the thus formed electrostatic latent image is developed with a developer in the developing unit 7 so as to be a visible image. The toner image on the photosensitive drum is transferred onto transfer paper by means of the transfer unit 8, and fixed through an ordinary method. Next, residual toner on the photosensitive drum 1 is cleaned by means of the cleaning unit 9 so as to be ready for the succeeding copying operation.

Figure 2:
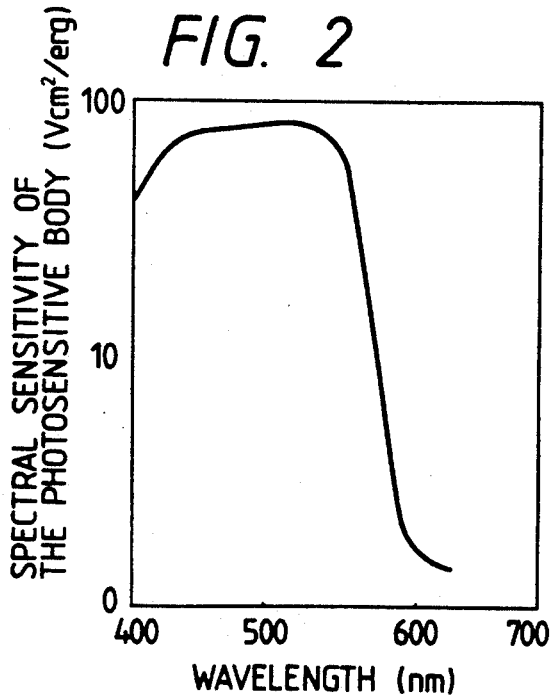
FIG. 2 is a graph showing the spectral sensitivity of the photosensitive body.
Figure 3:
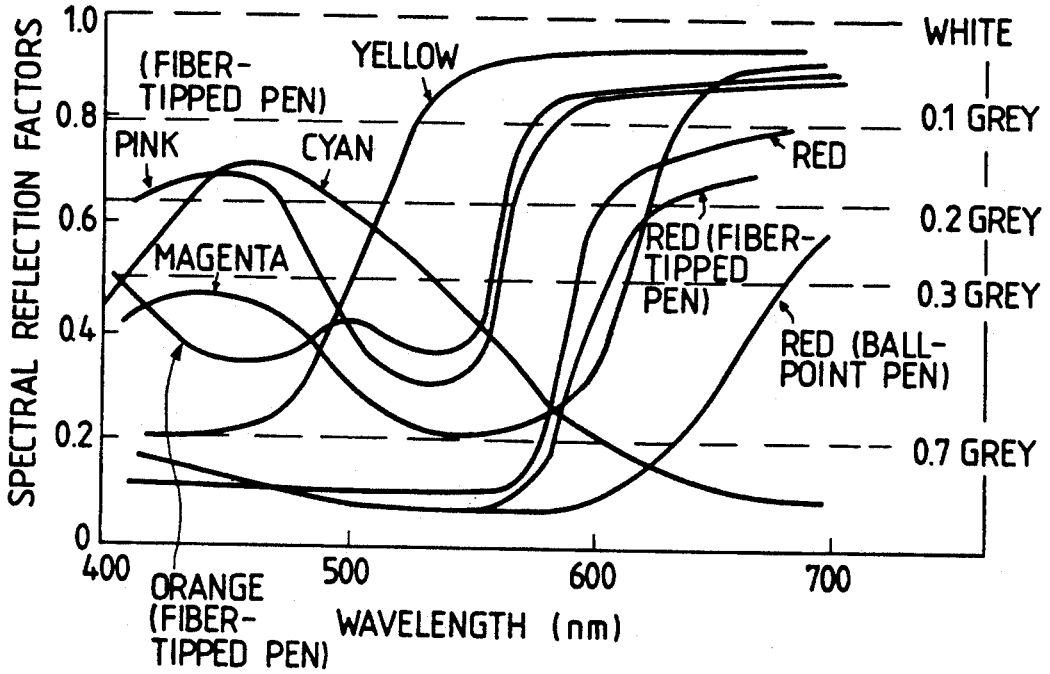
FIG. 3 is a graph showing the spectral reflection factors in color originals.
Figure 4:
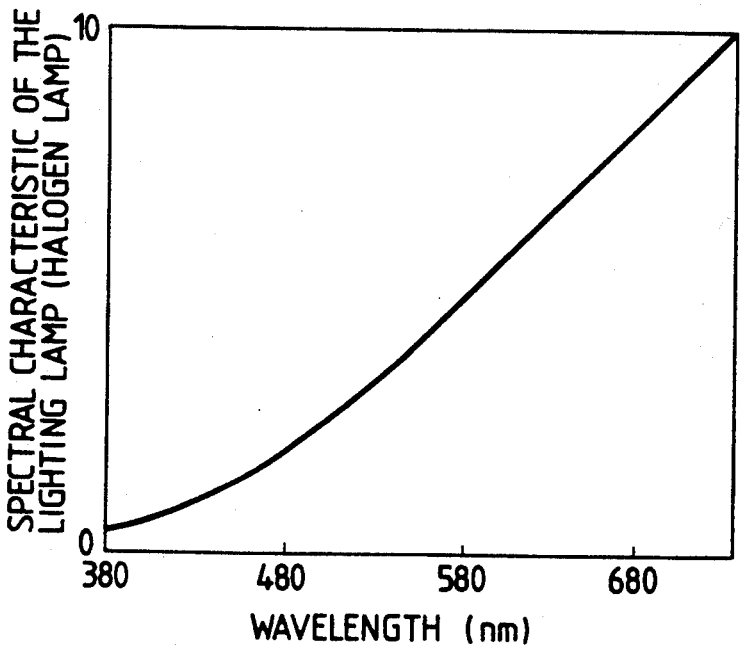
FIG. 4 is a graph showing the spectral characteristic of the lighting lamp (halogen lamp)
Figure 5:
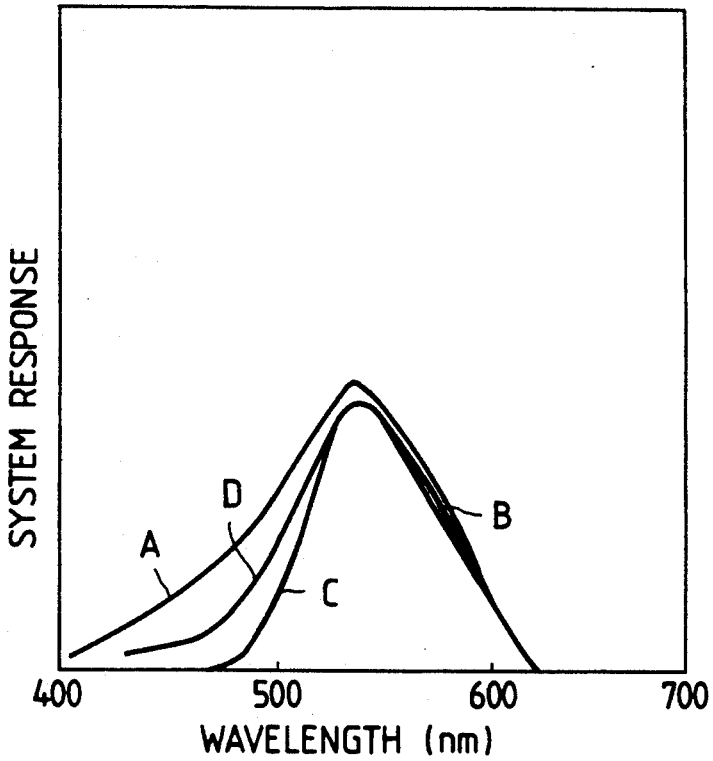
FIG. 5 is a graph showing the relation between the system response and the wavelength.

The photosensitive drum used had the spectral sensitivity as shown in FIG. 2, and the lighting lamp used had the spectral reflection factor as shown in FIG. 4. Copying was carried out under the following copying conditions.

| | |
|---|---|
| Photosensitive body surface potential | |
| dark portion | 700 V |
| white portion | 140 V |
| Development bias voltage | DC 220 V |
| filter | FUJI TAC FILTER SC-46,48,50,52 (produced by FUJI PHOTO FILM Co., Ltd.) |

Figure 7:
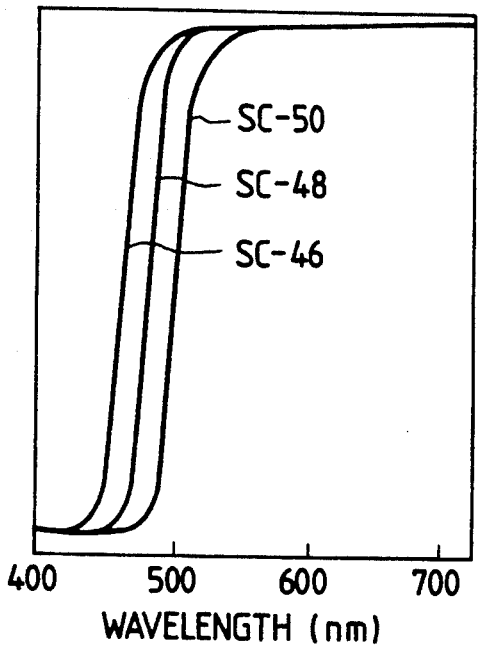
FIG. 7 is a graph showing the spectral transmission factors of the yellow filters.

The respective spectral transmission factors of the filters were as shown in FIG. 7.

Figure 1:
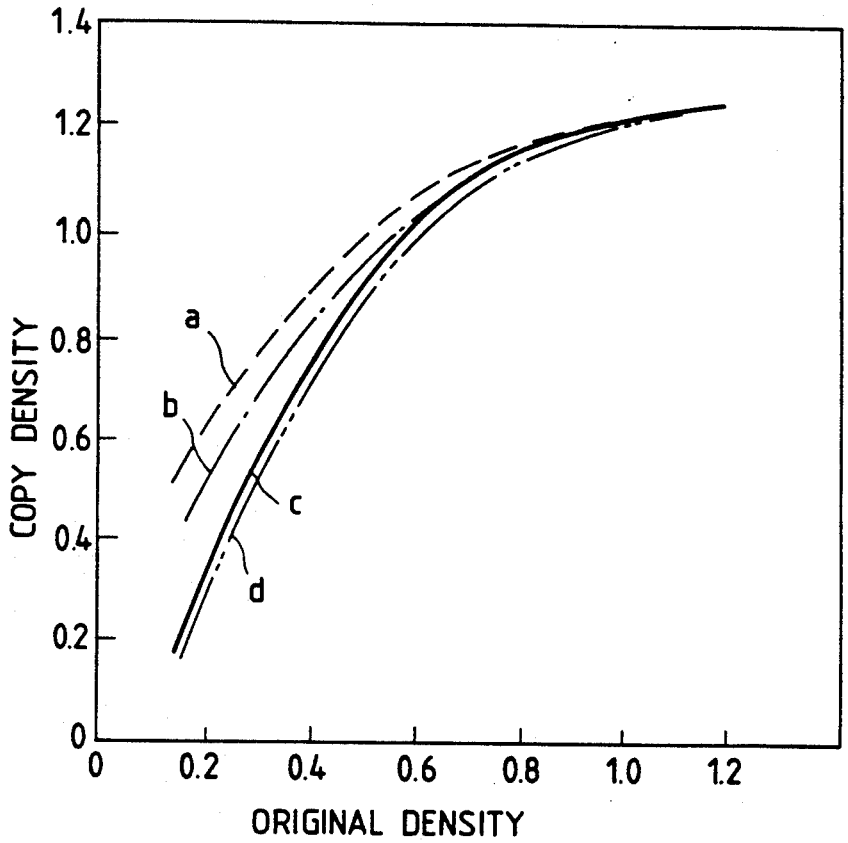
FIG. 1 is a graph showing the relation between the original density and the copy density.

FIG. 1 and Table 1 show the results of the copying operation.

FIG. 1 is a graph showing the relation between the original density and the copy density. In the drawing, the curve "a" represents the relation between the density of a grey-colored original and the copy density in the case of using no yellow filter, the curve "b" represents the relation between the density of a blue-colored (cyan-colored) original and the copy density in the case of using no yellow filter, the curve "c" represents the relation between the density of a blue-colored (cyan-colored) original and the copy density when sc-48 and sc-46 were used as the first and the second yellow filters respectively, and the curve "d" represents the relation between the density of a blue-colored (cyan-colored) original and the copy density when sc-50 and sc-46 were used as the first and the second yellow filters respectively.

As seen from the curves "a" and "b" of FIG. 1, the respective densities of the grey-colored and blue-colored originals were substantially equivalent to each other in the photosensitive body. Further, it was found that in the case of the curve "d," the increase at the low density side was larger than in the case of the curve "c". In this case, the reason why the increase in the high density side is small is that the quantity of development toner becomes near the saturated state. The density of the grey-colored original is fixed independently of the existence of the yellow filters because the reference quantity of light of the lamp is set by using the white portion potential as the index in advance.

TABLE

| Second filter | First filter SC-46 | First filter SC-48 | First filter SC-50 | First filter SC-52 |
|---|---|---|---|---|
| SC-46 | Blue-color reproducibility was not changed. No fog occurred in colored original. | Blue-color reproducibility was good. No fog occurred in colored original. | Blue-color reproducibility was good. No fog occurred in colored original. | Blue-color reproducibility was a little excessive. Slight fog occurred in pink-colored original. |
| SC-48 | Blue-color reproducibility was lowered. | Blue-color reproducibility was not changed. No fog occurred in colored original. | Blue-color reproducibility was good. No fog occurred in colored original. | Blue-color reproducibility was good. No fog occurred in colored original. |
| SC-50 | Blue-color reproducibility was poor. | Blue-color reproducibility was poor. | Blue-color reproducibility was lowered. | Blue-color reproducibility was not changed. No fog occurred in colored original. |
| SC-52 | Blue-color reproducibility was poor. | Blue-color reproducibility was poor. | Blue-color reproducibility was lowered. | Blue-color reproducibility was not changed. No fog occurred in colored original. |

As apparent from Table 1, the blue-color (cyan-color) reproducibility was not changed when the first yellow filter had the same spectral characteristic as that of the second yellow filter. When the cut-off density of the second yellow filter was shifted to the longer wavelength side than the first yellow filter, on the contrary, the blue-color (cyan-color) reproducibility was lowered.

The condition for the optimum combination of the first and the second yellow filters in the foregoing tests occurred where, the cut-off wavelength (the wavelength where the spectral transmission factor was 50%) of the first yellow filter was shifted to the long wavelength side by +200–+400 nm from the cut-off wavelength of the second yellow filter. If the cut-off wavelength is shifted to the long wavelength side, however, the efficiency of utilization of the lamp is reduced corresponding to the shift. Accordingly, it is preferable to use the yellow filters in the lower wavelength side.

Next, description will be made as to the means for preventing reduction of the resolving power due to curling of the filter in the case of using the first yellow filter.

Curling of the filter itself can be reduced to the level in which no problem is caused (the quantity of curling is not higher than 0.1 mm) by controlling the drying condition or the like in the filter producing process. Curling, however, can result and can cause reduction in resolving power when the filter is stuck on the attachment bracket through a double-sided adhesive tape.

As described above, according to the present invention, double-sided adhesive tap is stuck onto each of the first and the second yellow filters in the areas other than the optical path, and the first and the second yellow filters are then bonded onto the attachment bracket and the front surface of the sensor photodetective window respectively. In this case, it is preferable that the double-sided adhesive tape is stuck onto the sheet-like first yellow filter on the opposite ends that are parallel to the process direction of the photosensitive drum. As a result, an influence of filter curling on the optical performance generated from adhering the filter can be reduced to a practical level.

Figure 9A:
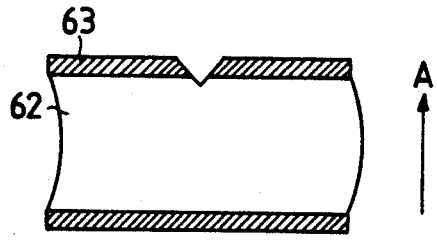
FIG. 9(*a*) and 9(*b*) are diagrams for explaining the curled and stuck states of th first filter.
Figure 9B:
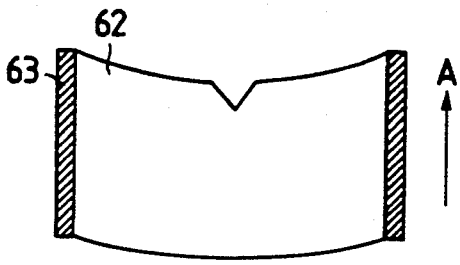

This point will be described further in detail. When yellow filter having the shape shown in FIG. 8 is attached using doublesided adhesive tape, two possibilities exist. In case (A), the yellow filter is stuck at opposite ends perpendicular to the process direction A of the photosensitive drum as shown in FIG. 9(*a*). In case (B), the yellow filter is stuck at opposite ends parallel to the process direction A of the photosensitive drum as shown in FIG. 9(*b*).

When the two cases were compared with each other, the following results were obtained.

Curling of the filter was generated when the filter was adhered using double-sided adhesive tape in the state where the filter was bent. Therefore, in both the cases (A) and (B), the relation between the quantity of curling and the depth of field at the focal position was investigated by using a filter in which the longitudinal size was 60 mm and the lateral size was 30 mm. As a result, an influence appeared when the quantity of curling was 1 mm–2 mm in the case of (A), while the influence in the case of (B) was not problematic, even when the quantity of curling was 2.5 mm. This is because the curvature of a curled surface in the case of (A) is a larger than that in the case of (B) although the quantity of curling is the same in both the cases. Therefore, in the case of attaching a rectangular filter, it is preferable that short opposite ends of the filter parallel to the process direction of the photosensitive drum are stuck using double-sided adhesive tape.

Further, although the effects obtained by the provision of the first and the second filters are the same between the cases of using a colored glass filter and an evaporation filter, it is necessary to pay attention to a variance of the focal length due to the glass plate thickness. Further, particularly in the case of using the evaporation system filter, it is necessary to perform characteristic design taking into consideration the fact that the spectral characteristic varies in accordance with the incident angle. In either cases, there are advantages and disadvantages in the performance, cost and durability. It is therefore necessary to use selectively the two different filters in accordance with the performance, specification, and cost of the copying apparatus to which the filter is applied.

According to the present invention, copying is performed by using the first filter provided in the optical path of the focusing optical system of the copying apparatus for cutting-off light having a wavelength not longer than a predetermined value and by using the second filter provided on the photo-detective surface of the light quantity sensor for controlling the quantity of light of the lighting means and having a cut-off wavelength point in the shorter wavelength side than the first filter. Therefore, even in the case of using a photosensitive body having low spectral sensitivity to a red-color region (600–700 nm), "blue-color reproduction defect (low density)" is not generated, and any change of reproducibility with respect to colored originals other than blue is hardly generated.

What is claimed is:

1. An apparatus for performing a copying operation comprising:

a photosensitive drum;

a focusing optical system having an optical path for directing reflected light from an original image onto said photosensitive drum;

an original lighting means for lighting said original image;

a light quantity sensor disposed relative to the focusing optical means for detecting the quantity of reflected light from said original image and for controlling the quantity of light of said original lighting means in accordance with the detected quantity of reflected light, said light quantity sensor having a light-detection surface;

a first filter provided in the optical path of said focusing optical system to cut-off light having a wavelength not longer than a predetermined value; and a second filter provided on the light-detection surface of said light quantity sensor and having a cut-off wavelength point shorter than said first filter.

2. The apparatus for performing copying operation according to claim 1, wherein said first filter includes a colored glass filter.

3. The apparatus for performing copying operation according to claim 1, wherein said second filter includes a colored glass filter.

4. The apparatus for performing copying operation according to claim 1, wherein said first filter includes an evaporation filter.

5. The apparatus for performing copying operation according to claim 1, wherein said second filter includes an evaporation filter.

6. The apparatus for performing copying operation according to claim 1, wherein said light quantity sensor includes a silicon photodiode light quantity sensor in which the long wavelength side is cut off.

7. The apparatus for performing copying operation according to claim 1, wherein the photosensitive body has a predetermined spectral sensitivity, and the light quantity sensor has a spectral sensitivity approximately corresponding to the spectral sensitivity of the photosensitive body.

8. The apparatus for performing copying operation according to claim 7, wherein the spectral sensitivity of the photosensitive body is low in the range of approximately 600–700 nm.

* * * * *